US009581120B2

(12) United States Patent
Morris

(10) Patent No.: US 9,581,120 B2
(45) Date of Patent: Feb. 28, 2017

(54) FUEL INJECTOR WITH INJECTION CONTROL VALVE CARTRIDGE

(71) Applicant: CUMMINS INC., Columbus, IN (US)

(72) Inventor: Corydon E. Morris, Columbus, IN (US)

(73) Assignee: Cummins Inc., Columbus, IN (US)

( * ) Notice: Subject to any disclaimer, the term of this patent is extended or adjusted under 35 U.S.C. 154(b) by 777 days.

(21) Appl. No.: 13/666,897

(22) Filed: Nov. 1, 2012

(65) Prior Publication Data

US 2013/0119162 A1 May 16, 2013

Related U.S. Application Data

(60) Provisional application No. 61/554,117, filed on Nov. 1, 2011.

(51) Int. Cl.

| | |
|---|---|
| ***F02M 61/16*** | (2006.01) |
| ***F02M 63/00*** | (2006.01) |
| ***F02M 63/02*** | (2006.01) |
| ***F02M 47/02*** | (2006.01) |
| ***F02M 59/36*** | (2006.01) |
| ***F02M 55/00*** | (2006.01) |
| ***F02M 51/06*** | (2006.01) |

(52) U.S. Cl.

CPC ..... *F02M 61/161* (2013.01); *F02M 47/027* (2013.01); *F02M 51/061* (2013.01); *F02M 55/002* (2013.01); *F02M 59/366* (2013.01); *F02M 63/0056* (2013.01); *F02M 63/0215* (2013.01); *F02M 63/0225* (2013.01)

(58) Field of Classification Search

CPC ..... F02M 63/0056; F02M 63/0215; F02M 63/0225; F02M 51/061; F02M 55/002

USPC ..... 239/585.1

See application file for complete search history.

(56) References Cited

U.S. PATENT DOCUMENTS

| | | | |
|---|---|---|---|
| 3,288,190 | A | 11/1966 | Holmes |
| 4,071,067 | A | 1/1978 | Goldby |
| 4,076,064 | A | 2/1978 | Holmes |
| 4,258,607 | A | 3/1981 | McKewan |
| RE31,284 | E | 6/1983 | Holmes |
| 4,485,969 | A | 12/1984 | Deckard et al. |

(Continued)

FOREIGN PATENT DOCUMENTS

| | | | |
|---|---|---|---|
| EP | 1 705 365 | B1 | 9/2006 |
| GB | 2 104 158 | A | 3/1983 |
| GB | 2 351 773 | A | 1/2001 |

OTHER PUBLICATIONS

International Search Report and the Written Opinion of the International Searching Authority dated Mar. 22, 2013 from corresponding International Application No. PCT/US2012/063111.

*Primary Examiner* — Arthur O Hall

*Assistant Examiner* — Chee-Chong Lee

(74) *Attorney, Agent, or Firm* — Faegre Baker Daniels LLP

(57) ABSTRACT

A fuel injector that includes an injector control valve assembly. The injector control valve assembly includes a contact spring positioned between a fuel injector upper body and the injector control valve assembly to isolate a stator housing from clamping forces that occur during fuel injector assembly and clamping in an internal combustion engine. The injector control valve assembly further includes a cartridge configuration that permits preassembly of the injector control valve assembly prior to mounting in the fuel injector.

21 Claims, 4 Drawing Sheets

(56) References Cited

U.S. PATENT DOCUMENTS

| | | | | |
|---|---|---|---|---|
| 4,661,031 | A | 4/1987 | Heine | |
| 4,911,127 | A | 3/1990 | Perr | |
| 5,169,270 | A | 12/1992 | Erickson | |
| 5,209,403 | A | 5/1993 | Tarr et al. | |
| 5,301,875 | A | 4/1994 | Gant et al. | |
| 5,501,197 | A | 3/1996 | Smith | |
| 5,542,799 | A | 8/1996 | Culpen | |
| 5,694,903 | A | 12/1997 | Ganser | |
| 5,720,318 | A | 2/1998 | Nagarajan et al. | |
| 5,785,024 | A * | 7/1998 | Takei et al. | 123/470 |
| 5,819,704 | A | 10/1998 | Tarr et al. | |
| 5,820,033 | A | 10/1998 | Cooke | |
| 5,904,300 | A | 5/1999 | Augustin | |
| 5,979,789 | A | 11/1999 | Sullivan et al. | |
| 6,056,264 | A | 5/2000 | Benson et al. | |
| 6,155,503 | A | 12/2000 | Benson et al. | |
| 6,161,813 | A * | 12/2000 | Baumgartner et al. | 251/50 |
| 6,286,768 | B1 | 9/2001 | Vetters et al. | |
| 6,298,826 | B1 | 10/2001 | Cotton, III | |
| 6,302,087 | B1 | 10/2001 | Schraudner et al. | |
| 6,305,355 | B1 | 10/2001 | Hoffmann et al. | |
| 6,378,497 | B1 | 4/2002 | Keyster et al. | |
| 6,439,202 | B1 | 8/2002 | Carroll, III et al. | |
| 6,655,602 | B2 | 12/2003 | Shafer et al. | |
| 6,655,610 | B2 | 12/2003 | Bulgatz et al. | |
| 6,796,543 | B2 | 9/2004 | Haeberer et al. | |
| 6,824,081 | B2 | 11/2004 | Peters et al. | |
| 6,840,268 | B2 | 1/2005 | Kennedy et al. | |
| 6,840,500 | B2 | 1/2005 | Dallmeyer et al. | |
| 6,997,165 | B2 | 2/2006 | Stockner et al. | |
| 7,025,045 | B2 | 4/2006 | Hlousek | |
| 7,156,368 | B2 | 1/2007 | Lucas et al. | |
| 7,159,800 | B2 | 1/2007 | Peterson, Jr. | |
| 7,309,033 | B2 * | 12/2007 | Dallmeyer | 239/585.1 |
| 7,318,417 | B2 | 1/2008 | Lang et al. | |
| 7,347,383 | B2 * | 3/2008 | Dallmeyer et al. | 239/5 |
| 7,428,893 | B2 | 9/2008 | Shinogle et al. | |
| 7,458,529 | B2 | 12/2008 | Ricco et al. | |
| 7,658,179 | B2 | 2/2010 | Bock et al. | |
| 7,661,410 | B1 | 2/2010 | Fuelberth et al. | |
| 7,954,787 | B2 | 6/2011 | Ricco et al. | |
| 8,172,161 | B2 | 5/2012 | Biagetti | |
| 2002/0020769 | A1 * | 2/2002 | Adachi et al. | 239/585.1 |
| 2004/0000600 | A1 * | 1/2004 | Peters et al. | 239/533.2 |
| 2004/0026540 | A1 | 2/2004 | Haeberer et al. | |
| 2009/0212134 | A1 | 8/2009 | Drake et al. | |
| 2009/0236441 | A1 * | 9/2009 | Hess et al. | 239/102.2 |
| 2009/0267008 | A1 | 10/2009 | Lucas et al. | |
| 2010/0012753 | A1 | 1/2010 | Corbinelli et al. | |

* cited by examiner

FUEL INJECTOR WITH INJECTION CONTROL VALVE CARTRIDGE

CROSS-REFERENCE TO RELATED APPLICATIONS

This application claims the benefit of priority to U.S. Provisional Patent Application No. 61/554,117, filed on Nov. 1, 2011, which is hereby incorporated by reference in its entirety.

TECHNICAL FIELD

This disclosure relates to control valves for fuel injectors.

BACKGROUND

A fuel injector control valve is critical to the operation of a fuel injector because it causes a nozzle valve element of a fuel injector to open and close, creating a fuel injection event. Such injector control valves are complex, including a plurality of components. Once an injector control valve is assembled into the fuel injector, it is held in place by an injector clamp load.

SUMMARY

This disclosure provides a fuel injector for injecting fuel at high pressure into a combustion chamber of an internal combustion engine, comprising an injector body and an injection control valve assembly. The injector body includes a longitudinal axis, an upper body portion, a lower body portion, a fuel delivery circuit, and an injector orifice to discharge fuel from the fuel delivery circuit into the combustion chamber. The injection control valve assembly includes a valve housing, a control valve member, an actuator, and a contact spring. The valve housing is positioned along the longitudinal axis in compressive abutment between the upper body portion and the lower body portion to create a force load on the valve housing. The control valve member is positioned in the valve housing to move between a first position and a second position. The actuator is positioned in the valve housing and adapted to cause movement of the control valve member between the first and the second positions. The actuator includes a stator housing positioned in the valve housing, and a stator positioned in the stator housing. The contact spring is positioned longitudinally between the stator housing and the upper body portion to impart a spring load to the stator housing.

This disclosure also provides an internal combustion engine, comprising an engine body that includes a combustion chamber and a fuel injector mounted in the engine body and receiving a clamping force. The fuel injector includes a longitudinal axis, an upper body portion, a lower body portion, a fuel delivery circuit, an injector orifice to discharge fuel from the fuel delivery circuit into the combustion chamber, and an injection control valve assembly. The injection control valve assembly includes a valve housing, a control valve member, an actuator, and a contact spring. The valve housing is positioned along the longitudinal axis in compressive abutment between the upper body portion and the lower body portion to create a force load on the valve housing. The control valve member is positioned in the valve housing to move between a first position and a second position. The actuator is positioned in the valve housing and adapted to cause movement of the control valve member between the first and the second positions. The actuator includes a stator housing positioned in the valve housing, and a stator positioned in the stator housing. The contact spring is positioned longitudinally between the stator housing and the upper body portion to impart a spring load to the stator housing such that the upper body portion, the valve housing, and the lower body portion are positioned to receive the clamping force and the stator housing is positioned to receive only the spring load.

This disclosure also provides an injection control valve assembly for a fuel injector, comprising a valve housing, a control valve member, an actuator, a cover plate, and a contact spring. The valve housing includes a valve cavity. The control valve member is positioned in the valve cavity to move between a first position and a second position. The actuator is positioned in the valve cavity and adapted to cause movement of the control valve member between the first and the second positions. The actuator includes a stator housing positioned in the valve cavity, and a stator positioned in the stator housing. The cover plate is mounted on the valve housing in compressive abutment with the valve housing. The contact spring is positioned in the valve cavity longitudinally between the stator housing and the cover plate in contact with the stator housing and the cover plate.

Advantages and features of the embodiments of this disclosure will become more apparent from the following detailed description of exemplary embodiments when viewed in conjunction with the accompanying drawings.

DETAILED DESCRIPTION

Figure 1:
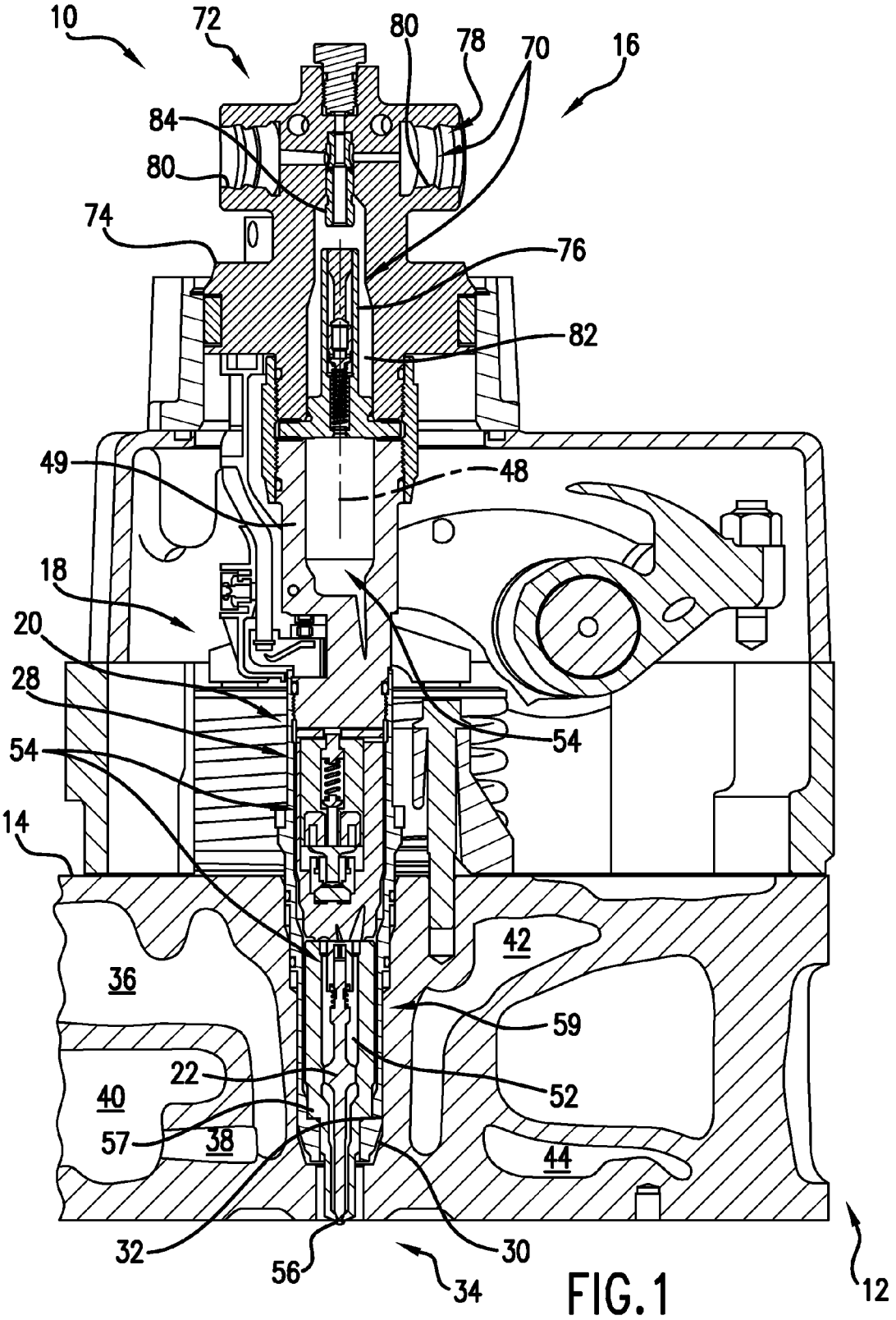
FIG. 1 is a cross-sectional view of a portion of an internal combustion engine.

Referring to FIG. 1, a portion of an internal combustion engine is shown generally indicated at 10. Engine 10 includes an engine body 12, which includes an engine block (not shown) and a cylinder head 14 attached to the engine block. Engine 10 also includes a fuel system 16 that includes one or more fuel injectors 18, a fuel pump, a fuel accumulator, valves, and other elements (not shown) that connect to fuel injector 18.

Figure 2:
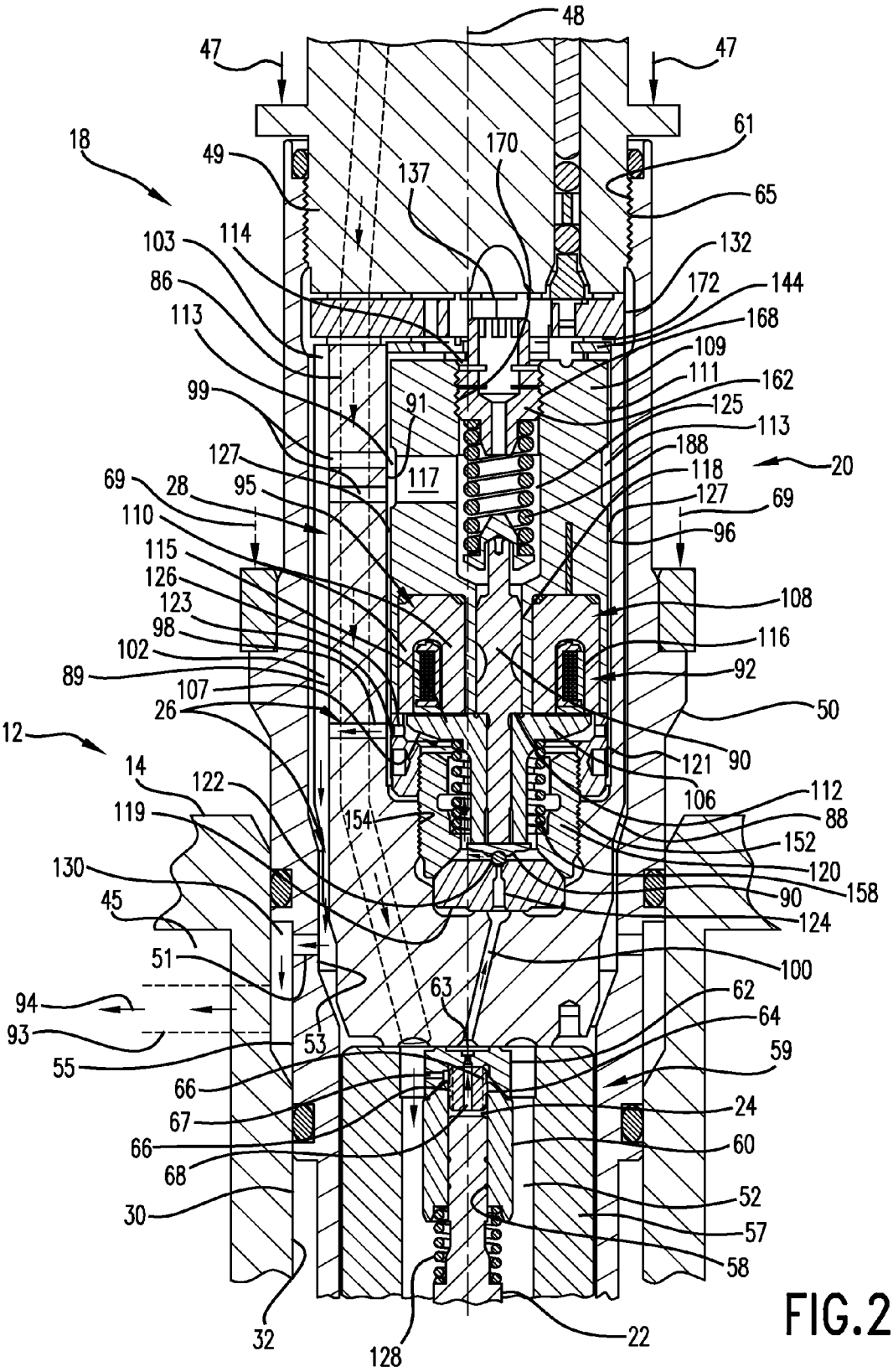
FIG. 2 is a cross-sectional view of a portion of the internal combustion engine of FIG. 1, showing a first exemplary embodiment of the present disclosure.
Figure 3:
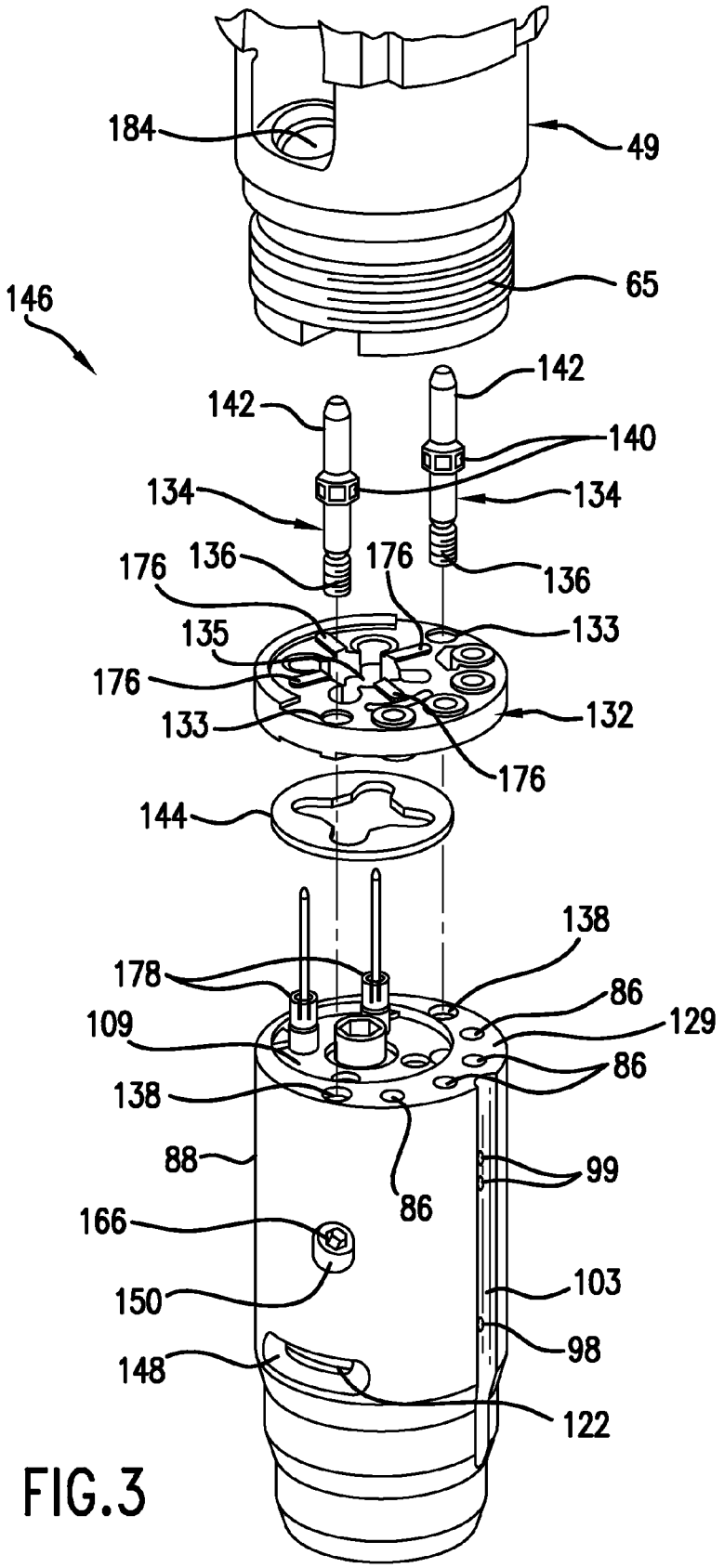
FIG. 3 is a perspective partially exploded view of a control valve assembly and upper body portion of FIG. 2.

Referring to FIGS. 1-3, fuel injector 18 includes an injector body 20, a nozzle valve element 22, a control volume 24, a drain circuit 26, and an injection control valve assembly 28.

Applicants recognized that an injection control valve assembly is a complex device containing many components, such as an actuator, a stator, a stator housing, an armature, a control valve member, and a load spring. These parts are usually assembled into the fuel injector device as individual components. Functionality of the injection control valve assembly is then verified as a part of a fuel injector. Since the injection control valve assembly consists of these many parts, the time-efficiency of installation in the fuel injector may be limited due to the assembly environment and could account for a significant portion of the fuel injector assembly cycle time. Additionally, validation of injection control valve assembly functionality as a part of the complete injector complicates the production and assembly validation and the diagnostic process.

Furthermore, applicants recognized that the actuator of the injection control valve assembly is subjected to high, undesirable compressive loads when assembled in the fuel injector and mounted or clamped into in the engine. Clamp load may vary, depending on installation variations due to the skills, knowledge or attentiveness of an installer, the type and calibration of tools used to install a fuel injector hold-down clamp, and environmental factors. Other factors may affect variation of fuel injector clamp load. Because the fuel injector clamp load compresses injection control valve assembly 28, the clamp load can cause significant variations in fuel injection quantity due control valve member stroke variations. Variations in fueling due to variations in fuel injector clamp load can cause emissions noncompliance, excessive wear on equipment, and loss of efficiency.

Injection control valve assembly 28 addresses these challenges by providing for a contact spring that provides isolation of the stator housing to compressive loads caused by assembly of injection control valve assembly 28 in fuel injector 18 and in engine body 12. Injection control valve assembly 28 may also be in the form of a cartridge that permits assembly independent of fuel injector 18 and may permit testing of control valve assembly 28 prior to installation in fuel injector 18.

Engine body 12 includes a mounting bore 30 formed by an inner wall or surface 32, sized to receive fuel injector 18. Engine body 12 also includes a combustion chamber 34 and one or more coolant passages 36, 38, 40, 42, 44 and 45 arranged about mounting bore 30 and along combustion chamber 34 to provide cooling to fuel injector 18 and components surrounding or adjacent combustion chamber 34. Combustion chamber 34, only a portion of which is shown in FIG. 1, is positioned in a known manner in engine body 12, between cylinder head 14 and the engine block (not shown). At least a portion of at least one coolant passage, e.g., coolant passages 36 and 42, extend in a longitudinal direction in a portion of cylinder head 14 alongside or adjacent mounting bore 30. At least a portion of at least one coolant passage, e.g., coolant passages 38 and 44, extend generally transverse to mounting bore 30 in a portion of cylinder head 14 that is at least partially alongside combustion chamber 34. Engine body 12 further includes a low-pressure engine drain circuit 94 including an engine drain passage 93 connected to a low-pressure drain, e.g., an engine fuel sump.

Throughout this specification, inwardly, distal, and near are longitudinally in the direction of combustion chamber 34. Outwardly, proximate, and far are longitudinally away from the direction of combustion chamber 34.

Injector body 20 includes a longitudinal axis 48 extending along the length of injector body 20, an upper body or barrel portion 49, an outer housing or retainer 50, and a lower body portion 59. Injector body 20 further includes a fuel delivery circuit 54, one or more injector orifices 56 positioned at a distal end of lower body portion 59, and an upper cavity 137 positioned between control valve assembly 28 and upper body portion 49. Lower body portion 59 includes a nozzle housing 57, and an injector cavity 52 located within nozzle housing 57. Injector orifice(s) 56 communicate with one end of injector cavity 52 to discharge fuel from fuel delivery circuit 54 into combustion chamber 34. Outer housing 50 secures upper body portion 49, injection control valve assembly 28, and lower body portion 59 in compressive abutment. In addition to locating the elements of fuel injector 18, outer housing 50 includes an interior surface 53, an exterior surface 55, a transversely or radially extending outlet port 51 positioned between interior surface 53 and exterior surface 55, and an internal thread 61. Upper body portion 49 includes access passage 184 and an external thread 65 that mates with outer housing internal threads 61 when outer housing 50 is attached to upper body portion 49.

Nozzle valve element 22 is positioned in one end of injector cavity 52 adjacent injector orifice 56. Nozzle valve element 22 is movable between an open position in which fuel may flow through injector orifice 56 into combustion chamber 34 and a closed position in which fuel flow through injector orifice 56 is blocked.

Nozzle valve element 22 extends into a nozzle element cavity 58 formed within a nozzle element guide 60. Control volume 24 is formed between an end of nozzle valve element 22 and an interior of nozzle element guide 60. Nozzle element guide 60 includes a proximal cap or end portion 62 and a control volume plug 64. End portion 62 of nozzle element guide 60 forms control volume 24 when end portion 62 and nozzle element guide 60 are mounted in injector cavity 52. Control volume plug 64 is mounted within nozzle element cavity 58 in a location adjacent to end portion 62. End portion 62 includes an end portion passage 63 that extends longitudinally through end portion 62 and one or more transverse end portion passages 67. Control volume plug 64 includes a plurality of longitudinal plug channels or passages 66 located about a periphery of control volume plug 64 and a longitudinally extending central passage 68. Control volume 24 receives high-pressure fuel from injector cavity 52 by way of transverse end portion passage 67 and plug passage 66. Central passage 68 is positioned to connect control volume 24 to end portion passage 63.

The pressure of fuel in control volume 24 determines whether nozzle valve element 22 is in an open position or a closed position, which is further determined by injection control valve assembly 28, described in more detail hereinbelow. When nozzle valve element 22 is positioned in injector cavity 52, nozzle element guide 60, and more specifically, end portion 62 of nozzle element guide 60, is positioned longitudinally between nozzle valve element 22 and injection control valve assembly 28. Other servo controlled nozzle valve assemblies may be used, such as those disclosed in U.S. Pat. No. 6,293,254, the entire content of which is hereby incorporated by reference.

A flow limiter assembly 72 may be positioned at a proximate end of fuel injector 18 and flow limiter assembly 72 may include a limiter outer housing 74 and a flow limiter sub-assembly 76. An inlet fuel circuit 70 extends through limiter outer housing 74 of flow limiter assembly 72 to connect fuel system 16 with fuel delivery circuit 54. Limiter outer housing 74 includes a high-pressure inlet 78, one or more bosses 80, and a housing recess or bore portion 82 into which a portion of flow limiter sub-assembly 76 extends. High-pressure inlet 78 may be connected to a fuel rail or accumulator (not shown), or may be a part of a daisy chain arrangement wherein other fuel injectors may be connected via appropriate high-pressure lines to, for example, bosses 80 integrally formed in limiter outer housing 74, either upstream or downstream of high-pressure inlet 78. Inlet fuel circuit 70 extends from high-pressure inlet 78 through limiter outer housing 74 and through flow limiter sub-assembly 76 to connect with fuel delivery circuit 54. Flow limiter assembly 72 may include a pulsation dampener 84 positioned along inlet fuel circuit 70, which serves to reduce transmission of pulsation waves, caused by injection events, between fuel injectors.

Fuel delivery circuit 54 is positioned to connect high-pressure fuel from inlet fuel circuit 70 to injector cavity 52 and control volume 24. Fuel delivery circuit 54 includes a plurality of longitudinally extending fuel delivery passages 86 extending through injection control valve assembly 28 to provide high-pressure fuel to injector cavity 52 and control volume 24. Injection control valve assembly 28 is positioned along drain circuit 26 and includes a valve housing 88 having a valve cavity 96 formed by a valve housing interior surface 91, a fuel injector control valve 95 positioned within valve cavity 96, and a contact spring 144. Valve housing 88 further includes at least one circumferential slot 148 and a longitudinal slot 150.

Valve housing 88 is positioned along longitudinal axis 48 between upper body portion 49 and lower body portion 59, and in compressive abutment with upper body portion 49 and lower body portion 59 to create a force load on valve housing 88. The force load on valve housing 88 is caused by two forces. During assembly, lower body portion 59 is positioned in a distal end of outer housing 50. Next, injection control valve assembly 28 is positioned along longitudinal axis 48 immediately adjacent to and in abutting contact with lower body portion 59 in outer housing 50. Lastly, outer housing portion 50 is secured to upper body portion 49 by outer housing internal threads 61 and upper body portion external threads 65, placing upper body portion 49 in abutting contact with valve housing 88 and transmitting a first load force through valve housing 88. When fuel injector 18 is mounted within engine body 12, fuel injector 18 is secured in engine body 12 by a clamping load or force 47, which is a second load force. A clamping load or force may be applied in various other locations on injector body 20, such as at location 69 on outer housing 50. Clamping load 47 may extend through upper body portion 49, valve housing 88, and lower body portion 59. The clamp force transmitted through lower body portion 59 is transmitted to engine body 12.

Injector control valve 95 includes a control valve member 90 and an actuator 92 positioned in valve housing 88. Actuator 92 is adapted to cause movement of control valve member 90 between a first, closed position and a second, open position. Control valve member 90 is positioned in valve cavity 96 to move reciprocally between the open position permitting flow through drain circuit 26 and the closed position blocking flow through drain circuit 26. Actuator 92 includes a solenoid assembly 108 that includes a stator housing 109 having a first end 112 and a second end 114, an upper or proximate face 129, a stator 110 positioned in stator housing 109, a coil 116 positioned circumferentially in and around stator 110, and an armature 106 operably connected to control valve member 90. Stator housing 109 is positioned in valve cavity 96 of valve housing 88 and stator housing 109 includes a stator housing exterior surface 111 extending between stator housing first end 112 to stator housing second end 114. Stator housing 109 further includes a central aperture, bore or core 118 extending through stator housing 109 from first end 112 to second end 114, and a transversely extending stator passage 117. Central aperture 118 includes a spring cavity 125 and is positioned to receive control valve member 90. An annular stator housing passage 113 is formed between valve housing interior surface 91 and exterior surface 111 of stator housing 109. In the exemplary embodiment, annular stator housing passage 113 is formed on exterior surface 111 of stator housing 109. Valve housing interior surface 91 is positioned a spaced transverse distance from exterior surface 111 of stator housing 109, forming an annular gap 127 along the entire axial extent of exterior surface 111 of stator housing 109. Annular gap 127 prevents mounting loads from being transmitted from valve housing 88 to stator housing 109 and permits air to travel between stator housing 109 and valve housing 88 to upper cavity 137 where the air remains or is dissolved into solution with the drain fuel over time.

Injection control valve assembly 28 also includes a seat portion 119, a seat retainer 120, and an adjusting ring 121 positioned in a distal end of valve cavity 96. Seat portion 119 includes a control valve seat 122 and a longitudinally extending seat portion passage 124. Adjusting ring 121 includes a plurality of radially or transversely extending adjusting ring passages 126. An annular groove 123 may be formed between an exterior of adjusting ring 121 and interior surface 91 of valve housing 88. In the exemplary embodiment, annular groove 123 is formed on an exterior of adjusting ring 121. Adjusting ring 121 is sized, positioned, and adjusted to space stator 110 and coil 116 an axial distance from armature 106 along longitudinal axis 48, which thus adjusts the armature stroke of armature 106.

When lower body portion 59, injection control valve assembly 28, and upper body portion 49 are assembled within outer housing 50, contact spring 144 is positioned along longitudinal axis 48 between stator housing 109 and upper body portion 49. Contact spring 144 provides a spring load to stator housing 109 to bias stator housing 109 toward a distal end of valve cavity 96. Contact spring 144 also isolates stator housing 109 from the compressive forces transmitted by assembly of lower body portion 59, injection control valve assembly 28, and upper body portion 49 in outer housing 50, as well as clamp load 47 when fuel injector 18 is assembled in engine body 12. The only longitudinal force transmitted to stator housing 109 is through contact spring 144 by way of the spring load of contact spring 144. When considered from the perspective of stator housing 109, stator housing 109 is positioned to receive only longitudinal forces transmitted through contact spring 144.

The force transmitted through valve housing 88 by installation of injection control valve assembly 28 into outer body portion 50 and the installation of fuel injector 18 in engine body 12 is significant and causes some compression of valve housing 88. However, valve housing 88 is structurally rigid and contact washer 144 is designed to provide a nominal bias on the components positioned within valve cavity 96. Thus, the additional compression of contact washer 144 by compression of structurally rigid valve housing 88 during assembly into outer housing 50 and during assembly of fuel injector 18 into engine body 12 transmits a negligible or structurally insignificant amount of load force through contact spring 144 to stator housing 109, effectively making stator housing 109 independent or free of mounting or clamp loads external to injection control valve assembly 28. Making stator housing 109 independent of mounting or clamp loads external to injection control valve assembly 28 ensures that the armature stroke and thus injector performance will not change due to mounting or clamping loads external to injection control valve assembly 28.

As best seen in FIG. 3, injection control valve assembly 28 may further include a cover plate 132 positioned longitudinally between upper body portion 49 and valve housing 88, which thus includes stator housing 109, and a plurality of retainers 134. Cover plate 132 includes a plurality of openings 133 and a central opening 135. Retainers 134 include a thread 136 formed at a first or distal end of retainers 134, an interface portion 140, and a pin portion 142. Retainers 134 include a retainer longitudinal portion that extends between interface portion 140 and threads 136. The retainer longitudinal portion may be configured similarly to pin portion 142. Valve housing 88 includes a plurality of threaded recesses 138 having threads that mate with threads 136. The first or distal end of retainers 134 extend through openings 133 formed in cover plate 132 to engage with threaded recesses 138. Interface portion 140 is shaped to mate with an adjusting tool (not shown) that permits retainers 134 to be tightened securely to valve housing 88.

In the exemplary embodiment, cover plate 132 is mounted in abutment to upper face 129 of valve housing 88 by retainers 134. Once cover plate 132 is securely connected to valve housing 88, contact spring 144 is compressed between cover plate 132 and stator housing 109 to provide a spring force or load on stator housing 109. Contact spring 144 is therefore positioned longitudinally between stator housing 109 and cover plate 132, and the components positioned in valve cavity 96, including control valve member 90, actuator 92, seat portion 119, seat retainer 120, and adjusting ring 121, are positioned within valve housing 88 to form a self-contained valve cartridge assembly 146. Because injection control valve cartridge assembly 146 is formed as a single integrated unit or a complete assembly, it may be easily installed or inserted within outer housing 50. Upper body portion 49 contains recesses (not shown) that mate with pin portion 142 to provide proper orientation of barrel or upper body portion 49 with cartridge assembly 146. Because cover plate 132 retains contact spring 144 in position, the spring load or force provided by contact spring 144 on stator housing 109 is fixed during assembly of cartridge assembly 146 in fuel injector 18. Furthermore and as previously described, contact spring 144 maintains the spring load independent of compressive mounting loads that originate outside valve cartridge assembly 146.

Figure 4:
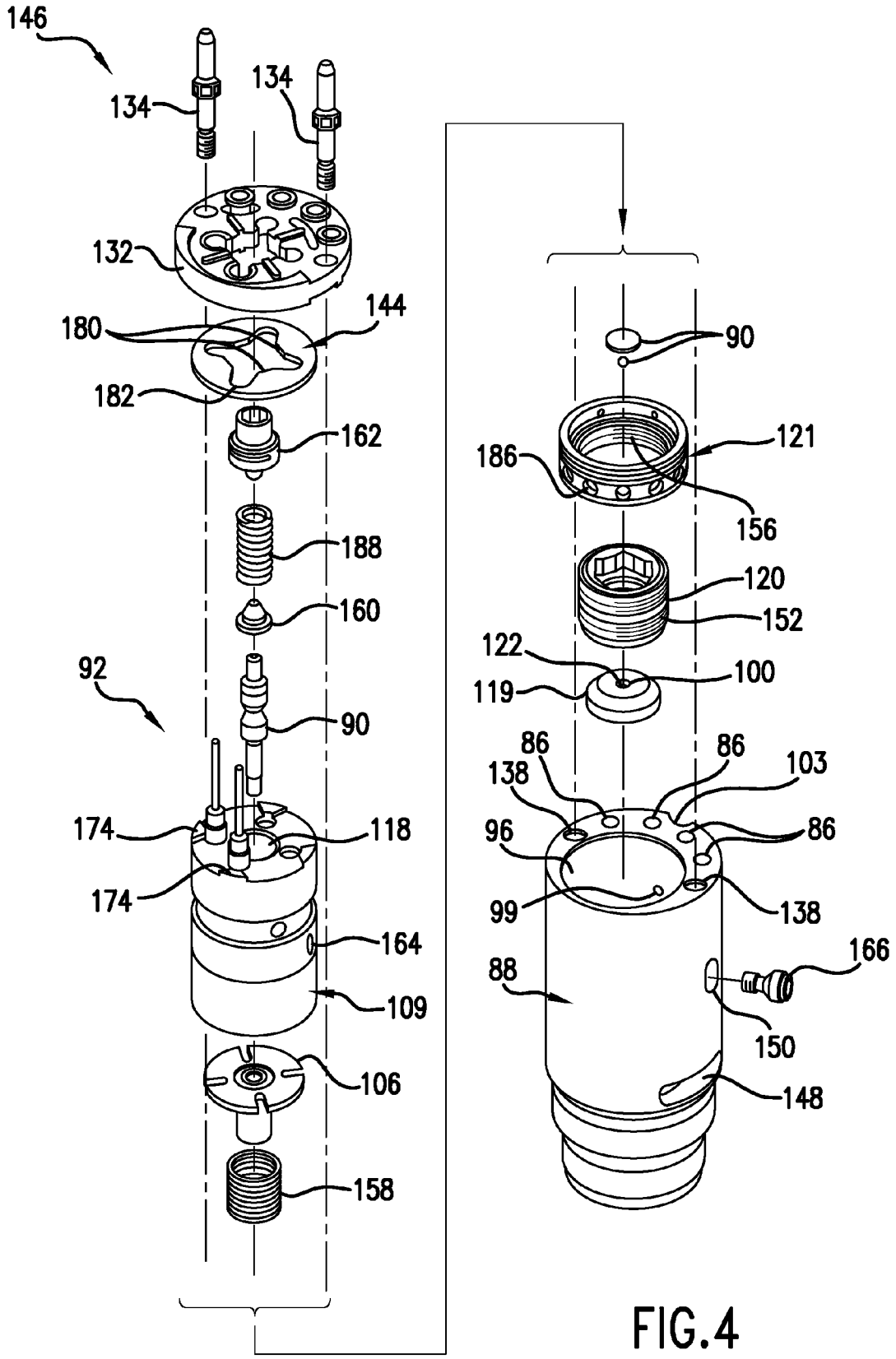
FIG. 4 is a perspective exploded view of the control valve assembly of FIG. 2.

Referring to FIGS. 2-4, seat portion 119 is positioned in a distal end of valve cavity 96 of valve housing 88. Seat retainer 120 includes an external seat retainer thread 152 and valve housing 88 includes an internal thread 154 that mates with threads 152. Seat retainer 120 is mounted in valve cavity 96 by way of seat retainer threads 152 and internal housing threads 154 to position and secure seat portion 119 at the distal end of valve cavity 196. Adjusting ring 122 includes an internal adjusting ring thread 156, which mate with seat retainer threads 152, and a plurality of adjusting ring engaging cavities 186, which are positioned circumferentially about the periphery of adjusting ring 122. When adjusting ring 122 is mounted within valve cavity 96, adjusting ring 122 is threaded on to seat retainer 120, but left untightened since adjusting ring 122 is needed to establish the armature stroke.

Injection control valve assembly 28 further includes an armature bias spring 158, a bias spring guide 160, a spring preload adjustment device 162 having external threads 168, an anti-rotation fastener 166, a plurality of electrical connections 178 extending longitudinally from stator housing 109, and a control valve member bias spring 188. Armature bias spring 158 is positioned along longitudinal axis 48 to be adjacent to seat retainer 120. Control valve member 90 is positioned in armature 106 and retained in armature 106. Control valve member 90 and armature 106 are positioned in valve cavity 96 that a distal end of control valve member 90 is in contact with control valve seat 122. Stator housing 109, which receives stator 110 and coil 116, is then positioned in valve cavity 96, receiving control valve member 90 in central core 118 as stator housing 109 is inserted or slid into valve cavity 96. Stator housing 109 further includes a threaded stator housing recess 164. When stator housing 109 is positioned in valve cavity 96, threaded stator housing recess 164 is positioned to align with longitudinal slot 150. Threaded stator housing recess 164 receives anti-rotation fastener 166, the head of which has sufficient clearance to permit the head to slide freely in longitudinal slot 150.

Bias spring guide 160 is positioned over a proximal end of control valve member 90 in central core 118 of stator housing 109. Central core 118 next receives control valve member bias spring 188, which abuts bias spring guide 160. Spring cavity 125 of central core 118 includes an internally threaded portion 170 that receives and engages external threads 168 of spring preload adjustment device 162. Spring preload adjustment device 162 is secured fully within spring cavity 125 to await further adjustment. Once stator housing 109 is positioned in valve cavity 96, a contact spring cavity 172 is located between a proximal end of stator housing 109 and proximal end 129 of valve housing 88 and receives contact spring 144. Stator housing 109 further includes a plurality of lands 174, which are in abutting contact with a distal side of contact spring 144 when contact spring 144 is positioned in contact spring cavity 172. Cover plate 132, which is identical on the proximal and the distal sides, includes a plurality of transversely extending cover plate lands 176. When cover plate 132 is positioned adjacent valve housing 88, cover plate 132 is rotationally oriented by engaging with electrical connections 178 and more accurately located by retainers 134.

The engagement of cover plate 132 with electrical connections 178 orients cover plate lands 176 circumferentially to extend radially between stator housing lands 174 when viewed from the proximal end of control valve assembly 28. In the exemplary embodiment, contact washer 144 is shaped in the form of a disk having a circumferential periphery. Contact washer 144 includes a plurality of radially inward portions 180 and a plurality of radially outward portions 182 positioned circumferentially about 45 degrees from radially inward portions 180 positioned radially adjacent an open interior of contact washer 144. Radially inward portions 180 appear as tabs in the open interior of contact washer 144. Cover plate lands 176 contact radially inward portions 180 on a proximal side of cover plate 132 and stator housing lands 174 contact radially outward portions 182 on a distal side of cover plate 132. Retainers or fasteners 134 are now inserted through cover plate 132, received by threaded recesses or cavities 138 formed in valve housing 88. Retainers 134 are tightened to secure cover plate 132 in abutting contact with valve housing 88, which also causes a preload force to be exerted on contact spring 144, providing a bias to stator housing 109 against adjusting ring 122. While the exemplary embodiment uses spacer plate 132, in another embodiment the features on spacer plate 132 may be provided on upper body 49, which may be in a direct abutting relationship with valve housing 88.

When fuel injector 18 is clamped into place, clamp load is directed through a plurality of cover plate lands 176 between a plurality of stator housing lands 174. Due to the thickness of contact spring 144 and the position of the load applied by lands 176 on contact spring 144 with respect to support lands 174, contact spring 144 deflects like individual beams in bending, with each supported on end and loaded in the middle. This configuration permits only a negligible amount of clamp load 47 to reach stator housing 109. Note that the thickness of contact spring 144 and the height of lands 176 directly affect the amount of clamp load force transmitted to stator housing 109. With a thinner contact spring 144 and a shorter longitudinal height for lands 176, the amount of clamp load transmitted through contact spring 144 is decreased. The choice of material for contact spring 144 also affects the clamp load transmitted.

Once control valve assembly 28 is assembled, control valve assembly 28 may be positioned within a test fixture and adjusted. A tool (not shown) may be inserted through circumferential slot 148 to engage adjusting ring engaging cavities 186. Adjusting ring 120 is rotated about longitudinal axis 48 to change the longitudinal position of adjusting ring 120, which sets the longitudinal position of stator housing 109. As stator housing 109 moves along longitudinal axis 48, it is prevented from rotating about longitudinal axis 48 by anti-rotation fastener 166, the head of which is positioned in longitudinal groove 150. The clearance of the head of anti-rotation fastener 166 with longitudinal groove 150 permits the head of anti-rotation fastener 166 to move with respect to valve housing 88 as stator housing 109 moves longitudinally within valve housing 88. By changing the position of stator housing 109, the armature stroke of armature 106 is adjusted. A tool may also be inserted into access passage 184 formed in upper body portion 49 to engage spring preload adjustment device 162. By adjusting spring preload adjustment device 162, the preload of control valve member bias spring 188 is adjusted which affects the on time of a fuel injector. Simultaneous to adjusting the armature stroke and the spring preload, the performance characteristics of control valve assembly 28 may be measured. Once the armature stroke and the spring preload have been adjusted, control valve assembly 28 is ready to be installed in fuel injector 18.

Valve housing 88 further includes a transversely or radially extending flow passage 98 connecting valve cavity 96 to an exterior of valve housing 88, a longitudinally extending first drain passage 100, and one or more relief passages 99. A longitudinally or axially inwardly extending flow passage 102 is provided to connect transversely extending passage 98 to outlet port 51. Inward flow passage 102 is formed between an exterior surface 89 of valve housing 88 and interior surface 53 of outer housing 50. In the exemplary embodiment, flow passage 102 includes an axial groove 103 formed in valve housing 88. Valve housing 88 also includes axially extending fuel delivery passage(s) 86, which are part of fuel delivery circuit 54. Axially inward flow passage 102 is positioned circumferentially adjacent to at least one fuel delivery passage 86, and may be positioned circumferentially adjacent to two fuel delivery passages 86. Transverse flow passage 98 is positioned a spaced circumferential distance from axially extending fuel delivery passages 86. Thus, transverse flow passage 98 extends between two adjacent fuel delivery passages 86, as best seen in FIG. 3. Transverse flow passage 98 is also positioned longitudinally in a location that is transversely adjacent to actuator 106, and, more specifically, is transversely or radially adjacent to the portion of valve cavity 96 that is adjacent armature 106, and more specifically, a distal surface 107 of armature 106. Because fuel injector 18 is typically operated in the orientation shown in FIG. 1, transverse flow passage 98 is also adjacent a portion of valve cavity 96 that is below or under distal surface 107 of armature 106. First drain passage 100 is positioned to connect injector cavity 52 to valve cavity 96.

Drain circuit 26 extends from control volume 24 through injection control valve assembly 28, through outer housing 50 into mounting bore 30, to engine drain passage 93 of low-pressure engine drain circuit 94. More specifically, drain circuit 26 includes central passage 68, end portion passage 63, first drain passage 100, seat portion passage 124, valve cavity 96, adjusting ring passage 126, annular groove 123, transverse flow passage 98, axially inward flow passage 102, and outlet port 51. Outlet port 51 is positioned longitudinally between injector orifice 56 and actuator 92, and may be positioned longitudinally between injector orifice 56 and control valve member 90. When fuel injector 18 is positioned in mounting bore 30, outer or exterior surface 55 of outer housing 50 is positioned adjacent to inner surface 32 of mounting bore 30, and an axially extending drain passage 130 is formed by exterior surface 55 of outer housing 50 and inner surface 32 of mounting bore 30. As described further hereinbelow, axial drain passage 130 is included as a part of drain circuit 26. Axial drain passage 130 overlaps at least one engine body coolant passage, e.g., coolant passage 45, in an axial direction, which means that axial drain passage 130 and coolant passage 45 are side-by-side or radially adjacent for at least a portion of axial drain passage 130. Axial drain passage 130 is positioned longitudinally between actuator 92 and injector orifice 56. More specifically, axial drain passage 130 extends longitudinally from outlet port 51 to a location adjacent engine drain passage 93 to permit fluid communication between outlet port 51 and engine drain passage 93.

When injector control valve 95 is energized by an engine control system (not shown), actuator 92 is operable to move armature 106 longitudinally toward stator 110. Movement of armature 106 causes control valve member 90 to move longitudinally away from control valve seat 122, which causes drain circuit 26 to be connected with control volume 64. Fuel is immediately able to flow outwardly through central passage 68, end portion passage 63, first drain passage 100, and seat portion passage 124. Fuel then flows between control valve member 90 and control valve seat 122 and into valve cavity 96. The fuel in valve cavity 96 continues to flow longitudinally outward toward and then transversely through adjusting ring passage 126. Because adjusting ring 121 is movable to establish the position of stator housing 109, adjusting ring passage 126 may be misaligned with transverse flow passage 98. Annular groove 123 permits fuel to flow from adjusting ring passage 126 to transverse flow passage 98, regardless of the position of adjusting ring passages 126 with respect to transverse flow passage 98. Transverse flow passage 98 is in fluid communication with valve cavity 96 at an upstream or first end and axially inward flow passage 102, and thus engine drain passage 93 of low-pressure drain 94, at a downstream or second end, receiving fuel flow from valve cavity 96 by way of adjusting ring passage 126. The first end of transverse flow passage 98 opens into valve cavity 96 in a location that is radially adjacent to armature 106, and more specifically, to distal surface 107 of a transverse portion 115 of armature 106. The fuel flows radially or transversely through adjusting ring passage 126, into annular groove 123, and into transversely extending passage 98, moving from valve cavity 96 into axially inward flow passage 102.

Because drain fuel flows directly from valve cavity 96 to axially inward flow passage 102 by way of transversely extending passage 98, the hot drain fuel is directed away from solenoid assembly 108, reducing the heat transferred from the hot drain fuel to solenoid assembly 108. In addition to reducing heat transfer to solenoid assembly 108, location of transversely extending passage 98 is advantageous in that the drain fuel is able to carry air and debris away from components such as armature 106 and stator 110, potentially improving the reliability and durability of these components.

Additionally, since transverse flow passage 98 is positioned circumferentially adjacent or between fluid delivery passage 86, there is some heat transfer from the hot drain fuel to the cooler fuel in fluid delivery passages 86, providing cooling to the hot drain fuel. Once in axially inward flow passage 102, fuel flows longitudinally or axially inwardly in a direction that is toward outlet port 51, where the fuel flows into outlet port 51. Axial drain passage 130 receives the drain fuel from outlet port 51, directing the drain fuel longitudinally or axially inwardly in a direction that is toward the distal end of fuel injector 18, which is toward injector orifices 56. The fuel then flows into engine drain passage 93 of low-pressure engine drain circuit 94. Thus, drain circuit 26 is positioned to receive drain fuel from control volume 24 and to drain the fuel toward low-pressure engine drain circuit 94.

With connection of control volume 24 to engine drain circuit 94, fuel pressure in control volume 24 is significantly reduced in comparison to fuel pressure in injector cavity 52. The pressure on the distal end of nozzle valve element 22 is significantly greater than the pressure on the proximate end of nozzle valve element 22, forcing nozzle valve element 22 longitudinally away from injector orifices 56, and permitting high-pressure fuel to flow from injector cavity 52 into combustion chamber 34, thus injection fuel under high pressure into combustion chamber 34. When actuator 92 is de-energized, control valve member 90 is biased by control valve member bias spring 188 to cause injector control valve 95 to close. When injector control valve 95 is closed, pressure builds in control volume 24, causing, in combination with a nozzle element bias spring 128, nozzle valve element 22 to move longitudinally toward injector orifices 56, closing or blocking injector orifices 56.

During operation, control valve member 90 moves up and down, causing a pumping action to occur in spring cavity 125. Stator passage 117 is positioned to connect spring cavity 125 to annular gap 127 and to one or more relief passages 99 formed in valve housing 88, thus providing an unrestricted venting of spring cavity 125, which allows unencumbered movement of control valve member 90.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

I claim:

1. A fuel injector for injecting fuel at high pressure into a combustion chamber of an internal combustion engine, comprising:

an injector body including a longitudinal axis, an upper body portion at a proximal end, a lower body portion at a distal end, a fuel delivery circuit, and an injector orifice to discharge fuel from the fuel delivery circuit into the combustion chamber; and an injection control valve assembly including a valve housing positioned along the longitudinal axis in compressive abutment between the upper body portion and the lower body portion to create a force load on the valve housing, the injection control valve assembly further including a control valve member positioned in the valve housing to move between a first position and a second position, and an actuator positioned in the valve housing and adapted to cause movement of the control valve member between the first and the second positions, the actuator including a stator housing positioned in the valve housing, and a stator positioned in the stator housing, the injection control valve assembly further including a contact spring positioned longitudinally between the stator housing and the upper body portion to impart a spring load to the stator housing toward the distal end of the injector body;

wherein the stator housing is positioned to receive a spring load transmitted by the contact spring without receiving a mounting load.

2. The injector of claim 1, the injection control valve assembly further including a cover plate positioned longitudinally adjacent the upper body portion and the valve housing, the contact spring being positioned longitudinally between the cover plate and the stator housing.

3. The injector of claim 2, wherein the cover plate is positioned in abutment with the valve housing to transmit a mounting load from the upper body portion to the valve housing.

4. The injector of claim 2, wherein the cover plate is securely connected to the valve housing to compress the contact spring to maintain the spring load independent of a mounting load on the stator housing.

5. The injector of claim 1, wherein the stator housing includes a first end, a second end, and an outer surface extending between the first and the second ends, the outer surface including an axial extent and positioned a spaced transverse distance from the valve housing along the entire axial extent to prevent mounting loads from the valve housing to be transmitted to the stator housing.

6. The injector of claim 1, wherein the injection control valve assembly further includes an armature operably connected to the control valve member, an adjusting ring positioned within the stator housing to permit adjustment of an armature stroke of the armature, and at least one opening formed in the valve housing to permit access to the adjusting ring to adjust the armature stroke.

7. The injector of claim 1, further including an outer housing connected to the upper body portion to hold the upper body portion, injection control valve assembly, and lower body portion in compressive abutment.

8. The injector of claim 7, wherein the valve housing includes an outer surface adjacent the outer housing and an inner surface adjacent the actuator.

9. The injector of claim 1, further including a nozzle valve element positioned in the lower body portion adjacent the injector orifice, the nozzle valve element movable between an open position in which fuel may flow through the injector orifice into the combustion chamber and a closed position in which fuel flow through the injector orifice is blocked, the injector further including a control volume positioned adjacent the nozzle valve element to receive a pressurized supply of fuel from the fuel delivery circuit, and a drain circuit positioned to drain fuel from the control volume toward a low pressure drain; the first position of the control valve member blocking flow through the drain circuit and the second position permitting flow through the drain circuit.

10. The injector of claim 1, wherein the contact spring is positioned within an upper portion of the injection control valve assembly.

11. The injector of claim 1, wherein the contact spring is positioned longitudinally above both a first end and a second end of the stator housing.

12. The injector of claim 1, wherein the valve housing is separate from the upper body portion and the lower body portion.

13. The injector of claim 1, wherein the valve housing includes a valve cavity.

14. An internal combustion engine, comprising:

an engine body including a combustion chamber; and a fuel injector mounted in the engine body and receiving a clamping force, the fuel injector including a longitudinal axis, an upper body portion at a proximal end, a lower body portion at a distal end, a fuel delivery circuit, an injector orifice to discharge fuel from the fuel delivery circuit into the combustion chamber, and an injection control valve assembly including a valve housing positioned along the longitudinal axis in compressive abutment between the upper body portion and the lower body portion to create a force load on the valve housing, the injection control valve assembly including a control valve member positioned in the valve housing to move between a first position and a second position, and an actuator positioned in the valve housing and adapted to cause movement of the control valve member between the first and the second positions, the actuator including a stator housing positioned in the valve housing, and a stator positioned in the stator housing, the injection control valve assembly further including a contact spring positioned longitudinally between the stator housing and the upper body portion to impart a spring load to the stator housing toward the distal end of the fuel injector such that the upper body portion, the valve housing, and the lower body portion are positioned to receive the clamping force and the stator housing is positioned to receive the spring load without the clamping force.

15. The internal combustion engine of claim 14, the injection control valve assembly further including a cover plate positioned longitudinally adjacent the upper body portion and the valve housing, the contact spring being positioned longitudinally between the cover plate and the stator housing.

16. The internal combustion engine of claim 15, wherein the cover plate is positioned in abutment with the valve housing to transmit the clamping force from the upper body portion to the valve housing.

17. The internal combustion engine of claim 15, wherein the cover plate is securely connected to the valve housing to compress the contact spring to maintain the spring load independent of the clamping force on the stator housing.

18. The internal combustion engine of claim 14, wherein the stator housing includes a first end, a second end, and an outer surface extending between the first and the second ends, the outer surface including an axial extent and positioned a spaced transverse distance from the valve housing along the entire axial extent to prevent the clamping force from the valve housing to be transmitted to the stator housing.

19. The internal combustion engine of claim 14, wherein the injection control valve assembly further includes an armature operably connected to the control valve member, an adjusting ring positioned within the stator housing to permit adjustment of an armature stroke of the armature, and at least one opening formed in the valve housing to permit access to the adjusting ring to adjust the armature stroke.

20. The internal combustion engine of claim 14, further including an outer housing connected to the upper body portion to hold the upper body portion, injection control valve assembly, and lower body portion in compressive abutment.

21. The internal combustion engine of claim 14, further including a nozzle valve element positioned in the lower body portion adjacent the injector orifice, the nozzle valve element movable between an open position in which fuel may flow through the injector orifice into the combustion chamber and a closed position in which fuel flow through the injector orifice is blocked, the injector further including a control volume positioned adjacent the nozzle valve element to receive a pressurized supply of fuel from the fuel delivery circuit, and a drain circuit positioned to drain fuel from the control volume toward a low pressure drain; the first position of the control valve member blocking flow through the drain circuit and the second position permitting flow through the drain circuit.

* * * * *